US010407293B2

(12) United States Patent
Tran

(10) Patent No.: US 10,407,293 B2
(45) Date of Patent: Sep. 10, 2019

(54) SMART LIQUID DISPENSER SYSTEM

(71) Applicant: The United States of America as represented by the Secretary of the Navy, San Diego, CA (US)

(72) Inventor: Nghia X. Tran, San Diego, CA (US)

(73) Assignee: United States as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 15/617,459

(22) Filed: Jun. 8, 2017

(65) Prior Publication Data

US 2018/0354779 A1 Dec. 13, 2018

(51) Int. Cl.

| | |
|---|---|
| ***B67D 7/14*** | (2010.01) |
| ***B67D 7/02*** | (2010.01) |
| ***B67D 7/16*** | (2010.01) |
| ***B67D 7/22*** | (2010.01) |
| ***A61J 7/04*** | (2006.01) |
| ***A61J 1/20*** | (2006.01) |
| ***A61J 1/10*** | (2006.01) |
| ***A61J 1/22*** | (2006.01) |
| ***A61J 1/14*** | (2006.01) |

(52) U.S. Cl.

CPC ..... *B67D 7/145* (2013.01); *A61J 1/10* (2013.01); *A61J 1/2089* (2013.01); *A61J 1/22* (2013.01); *A61J 7/0436* (2015.05); *A61J 7/0481* (2013.01); *B67D 7/02* (2013.01); *B67D 7/16* (2013.01); *B67D 7/221* (2013.01); *A61J 1/1412* (2013.01); *A61J 2200/30* (2013.01); *A61J 2200/72* (2013.01); *A61J 2200/76* (2013.01)

(58) Field of Classification Search

CPC ..... B67D 7/02; B67D 7/0205; B67D 1/0878; B67D 7/221; B67D 1/0881; B67D 1/0888; B67D 1/10; B67D 3/0077; B67D 3/0006; B65D 51/1644; B65D 2205/00; B05B 11/30; B05B 11/047; B05B 11/0044; B05B 11/0039

See application file for complete search history.

(56) References Cited

U.S. PATENT DOCUMENTS 3,170,597 A * 2/1965 Reichenberger ..... B67D 3/0051 222/30
3,688,947 A * 9/1972 Reichenberger ..... B67D 1/08 222/129.1
3,920,149 A * 11/1975 Fortino ..... B67D 3/0006 222/1
4,436,223 A * 3/1984 Wilson ..... B67D 3/0051 222/36
4,598,845 A * 7/1986 Ozdemir ..... B67D 1/12 222/447
4,736,871 A * 4/1988 Luciani ..... B65D 51/248 222/25

(Continued)

*Primary Examiner* — Patrick M. Buechner

(74) *Attorney, Agent, or Firm* — Naval Information Warfare Center Pacific; Kyle Eppele; Susanna Torke

(57) ABSTRACT

The system described herein employs electronic technology to improve the ability to dispense liquid from a container. The container can be programmed to dispense a specific amount of liquid, at a specific time. It can be voice-activated and connected to other electrical components such as a laptop or alarm system. The system may be used in laboratory equipment, medicine bottles, and food processors, although alternate methods may also be used.

10 Claims, 8 Drawing Sheets

(56) References Cited

U.S. PATENT DOCUMENTS

| | | | | | |
|---|---|---|---|---|---|
| 5,044,521 | A * | 9/1991 | Peckels | B67D 3/0051 | 215/329 |
| 5,255,819 | A * | 10/1993 | Peckels | B67D 3/0041 | 222/1 |
| 5,318,197 | A * | 6/1994 | Martindale | B67D 1/1234 | 222/1 |
| 5,472,112 | A * | 12/1995 | Maciejewski | B65D 23/00 | 141/309 |
| 5,505,349 | A * | 4/1996 | Peckels | B67D 3/0041 | 222/36 |
| 5,603,430 | A * | 2/1997 | Loehrke | B67D 1/0888 | 222/1 |
| 6,354,468 | B1 * | 3/2002 | Riek | B67D 3/0051 | 222/129.3 |
| 6,409,046 | B1 * | 6/2002 | Peckels | B67D 3/0041 | 222/1 |
| 7,864,053 | B2 * | 1/2011 | August | G06K 19/0717 | 235/375 |
| 9,138,109 | B1 * | 9/2015 | Leon | A47K 5/1217 | |
| 2003/0055589 | A1 * | 3/2003 | Mogadam | B67D 1/00 | 702/100 |
| 2005/0194402 | A1 * | 9/2005 | Morrison | B65D 47/06 | 222/113 |
| 2006/0249540 | A1 * | 11/2006 | Arghyris | B05B 11/0072 | 222/321.7 |
| 2008/0195251 | A1 * | 8/2008 | Milner | B67D 3/0035 | 700/237 |
| 2009/0212132 | A1 * | 8/2009 | Simmonds | A61L 2/035 | 239/289 |
| 2012/0211516 | A1 * | 8/2012 | Zapp | B65D 25/48 | 222/20 |
| 2016/0257554 | A1 * | 9/2016 | Manwani | B67D 3/0067 | |
| 2019/0101112 | A1 * | 4/2019 | Scalf | F04B 13/00 | |

* cited by examiner

SMART LIQUID DISPENSER SYSTEM

FEDERALLY-SPONSORED RESEARCH AND DEVELOPMENT

The Smart Liquid Dispenser System is assigned to the United States Government and is available for licensing for commercial purposes. Licensing and technical inquiries may be directed to the Office of Research and Technical Applications, Space and Naval Warfare Systems Center, Pacific, Code 72120, San Diego, Calif., 92152; voice (619) 553-5118; email ssc_pac_T2@navy.mil. Reference Navy Case Number 103680.

BACKGROUND

The embodiments described herein employ electronic technology to improve the ability to dispense liquid from a container. The embodiments may allow for use in laboratory equipment, medicine bottles, and food processors, although alternate embodiments may also be used.

DETAILED DESCRIPTION OF SOME EMBODIMENTS

Reference in the specification to "one embodiment" or to "an embodiment" means that a particular element, feature, structure, or characteristic described in connection with the embodiments is included in at least one embodiment. The appearances of the phrases "in one embodiment", "in some embodiments", and "in other embodiments" in various places in the specification are not necessarily all referring to the same embodiment or the same set of embodiments.

Some embodiments may be described using the expression "coupled" and "connected" along with their derivatives. For example, some embodiments may be described using the term "coupled" to indicate that two or more elements are in direct physical or electrical contact. The term "coupled," however, may also mean that two or more elements are not in direct contact with each other, but yet still co-operate or interact with each other. The embodiments are not limited in this context.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or.

Additionally, use of the "a" or "an" are employed to describe elements and components of the embodiments herein. This is done merely for convenience and to give a general sense of the invention. This detailed description should be read to include one or at least one and the singular also includes the plural unless it is obviously meant otherwise.

Figure 1A:
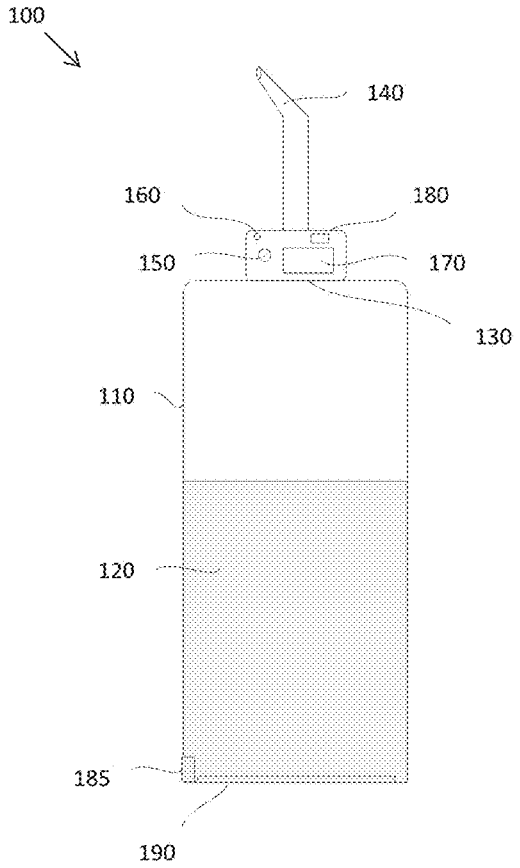
FIG. 1A shows a front view of a Smart Liquid Dispenser System.
Figure 1B:
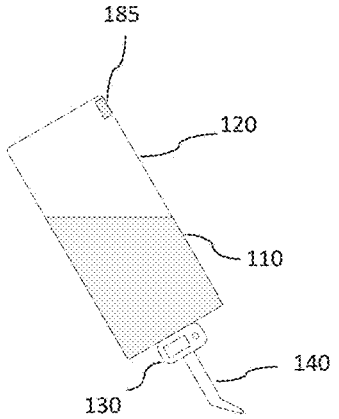
FIG. 1B shows a front view of an inverted Smart Liquid Dispenser System.
Figure 1C:
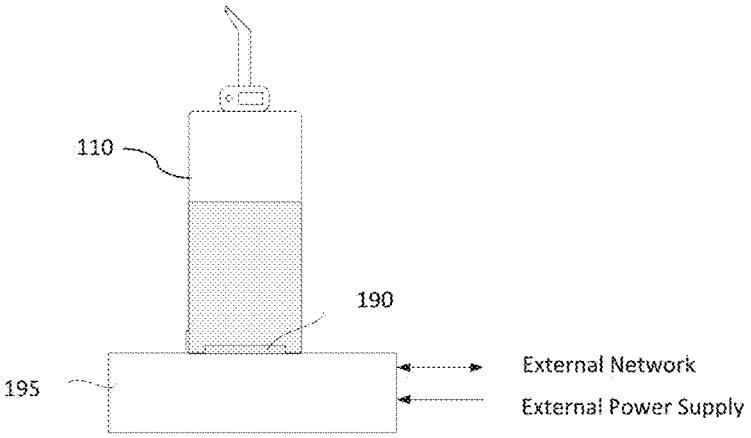
FIG. 1C shows a front view of a Smart Liquid Dispenser System sitting on top of a charging station.

FIGS. 1A-1C show various embodiments of a Smart Liquid Dispenser system 100. In FIG. 1A, system 100 has a liquid container 110. Liquid container 110 contains a liquid 120. Liquid container 110 has an electronic control unit (ECU) 130 controlling the amount of liquid 120 dispensed through a nozzle 140. ECU 130 can record the amount of liquid 120 dispensed, rates, schedules, and other information. Liquid container 110 has select buttons 150, and a microphone 160, for which a user can command ECU 130 to dispense a required amount of liquid 120 at a desired rate. ECU 130 has a display 170 that provides visual input response and operation status, and a speaker 180 that informs a user of audible messages or alarm to a user. System 100 has an air valve 185 to allow air to enter the bottle when dispensing the liquid. System 100 also has a charge circuit 190 that can be configured to be wireless.

FIG. 1B shows a container 110 having a liquid 120, an ECU 130, a nozzle 140 and an air valve 185 in an upside-down position. In this embodiment, ECU 130 also has an orientation sensor (not shown here). When a user holds liquid container 110 in an inverted position, the orientation sensor commands ECU 130 to dispense the liquid through nozzle 140. Liquid 120 can be actively pumped out with a pumper (seen in FIG. 2) or passively poured out via nozzle 140. Air valve 185 allows air to go into the bottle, the air pushing liquid 120 out. Air valve 185 can be electronically controlled or air can be vented in. This embodiment can also have a flow sensor (not shown here) attached to nozzle 140 measuring the amount and rate of dispensed liquid 120. This information is sent to ECU 130 as feedback information, to help ensure system 100 dispenses the correct amount of liquid 120 at a desired rate. When the dispensed liquid 120 reaches the setting amount, the pumper (FIG. 2) can be commanded to stop. Air valve 185 may be controlled to open and close. ECU 130 can also have a liquid level sensor (not shown here) making it possible to determine the level of liquid remaining in container 110. Other embodiments of Smart Liquid Dispenser system 100 could have additional sensors including temperature, chemical, pressure, or color sensors, or also a pumper to aid in dispensing liquid 120.

FIG. 1C shows container 110 wherein charge circuit 190 is mounted on top of a charging station 195. Charging station 195 charges a battery (shown in FIG. 2) on ECU 130, supplying power to container 110, allowing the "smart" features of system 100 to be operable. Container 110 can operate while away from charging station 195 or while sitting on charging station 195 while charging. Charge circuit 190 may include a near field communication (NFC)

device to allow container 110 to communicate with charging station 195, exchanging battery charge management information. ECU 130 can also be connected to an external network via the NFC. Charging station 195 can be electrically and/or operably connected to an external network and an external power supply.

Figure 2:
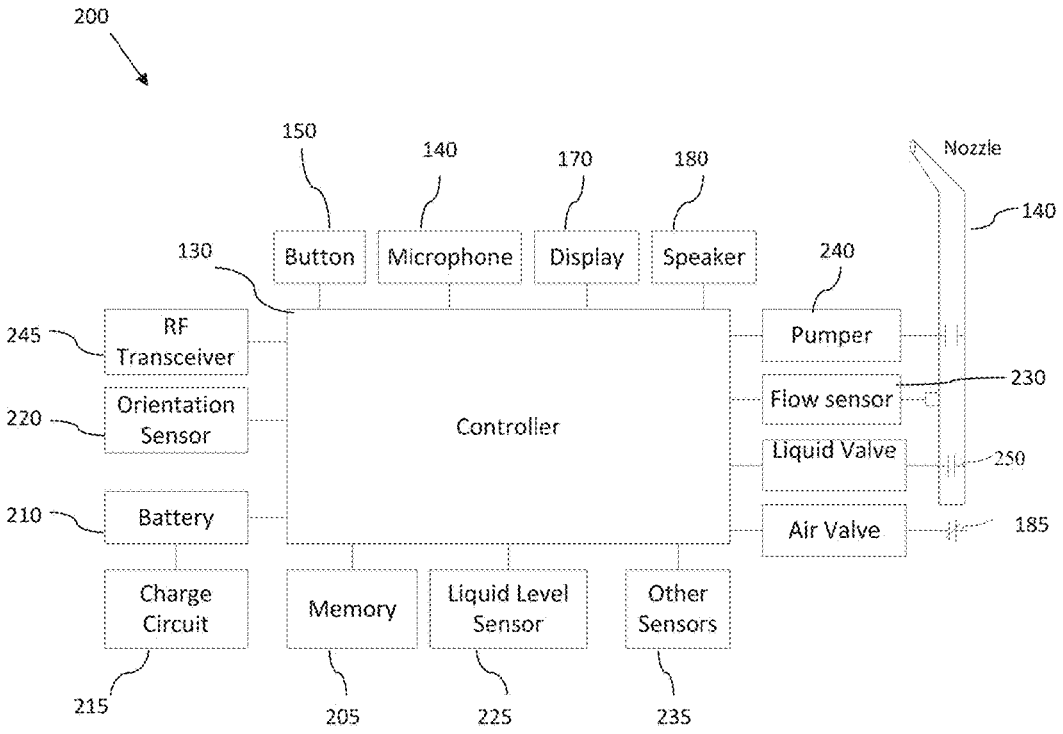
FIG. 2 shows a component diagram of an electronic control unit attached to a nozzle in accordance with the Smart Liquid Dispenser System.

FIG. 2 shows an embodiment of ECU 130 and various component parts that may be incorporated within. ECU 130 can have a memory 205 to store information such as amount of liquid dispensed, schedules, and more. ECU 130 can have a battery 210 and a charge circuit 215. Battery 210 can be a one-time use battery for a disposable dispenser or rechargeable battery for a reusable application. Battery 210 provides electric power for all electronic components to operate. Battery 210 can be charged with wire or wireless methods via a charging circuit 190 and charging station 195 (shown in FIG. 1C).

ECU 130 can have various sensors, such as an orientation sensor 220, a liquid level sensor 225, a flow sensor 230, and any other sensors 235. Flow sensor 230 and a pumper 240 are also connected to nozzle 140 where liquid can be dispensed. ECU 130 can have a radio frequency (RF) transceiver 245 that can provide a wireless link to other devices for remote monitoring and to control network operations. As discussed and shown in FIG. 1A, ECU 130 can also have a button 150, a microphone 160, a display 170, and a speaker 180 to allow for voice recognition and provide visual and audio feedback to users. ECU 130 can also have an air valve 185 and a liquid valve 250.

Figure 3:
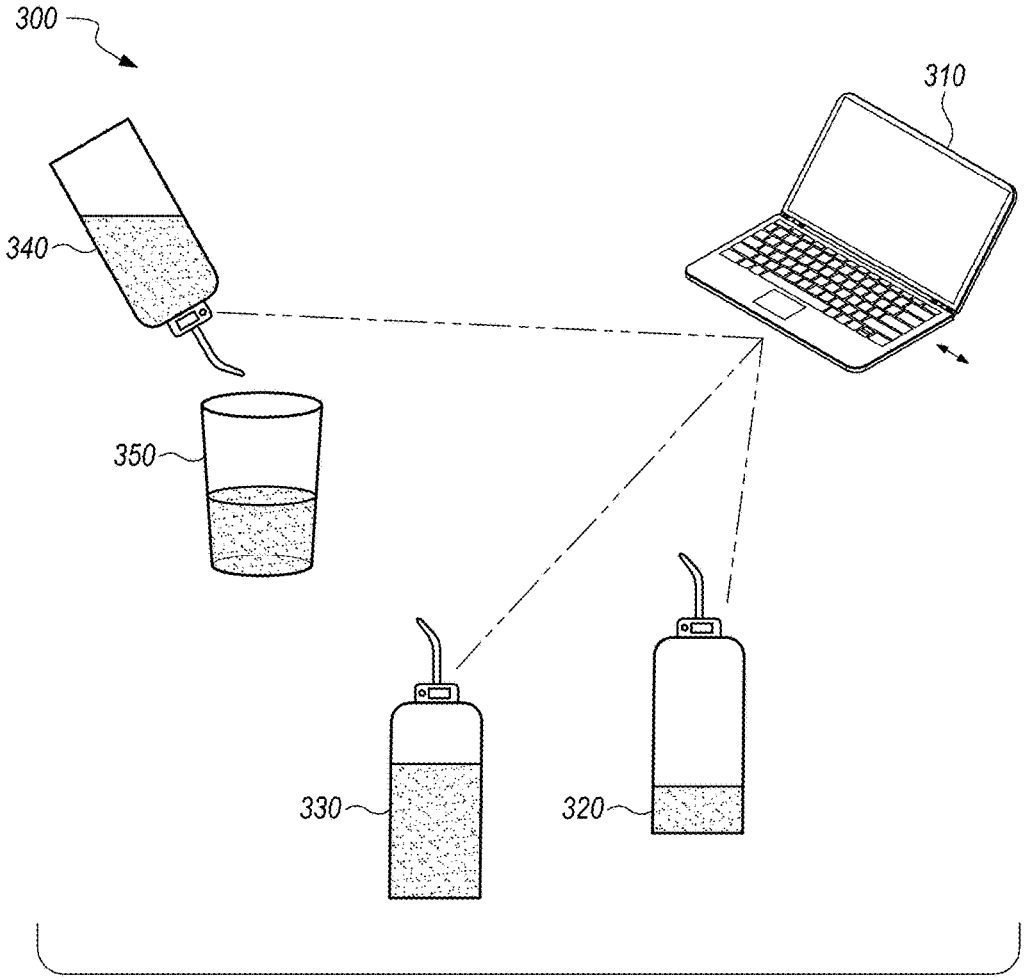
FIG. 3 shows a Smart Liquid Dispenser System connected to a network.

FIG. 3 shows an operation 300 of multiple Smart Liquid Dispenser Systems in a wireless network application. A host controller 310 may contain a display and an input keyboard server as user input and interaction, main processor, microphone, speaker, memory to hold procedure, wireless transceiver and Ethernet connection. Host controller 310 can be wirelessly connected to multiple smart liquid dispenser systems 320, 330, and 340, each filled with liquid. In this embodiment, host controller 310 can instruct a user to create a liquid mixture using the liquid in dispenser systems 320, 330, and 340 in a chemical laboratory. The specific amount of liquid to be dispensed, the dispense rate and time, and the order in which the liquid is to be dispensed are all sent wirelessly from host controller 310 to dispenser systems 320, 330, and 340. Host controller 310 will then instruct a user to dispense the liquids into a separate container 350. The rates, time, and amount of each liquid to be dispensed is controlled by the dispenser system's individual ECU (as seen in previous figures), based on the information it receives from host controller 310.

Each smart liquid dispenser system may have a unique identifier that can be used for inventory and location purposes. The smart liquid dispenser systems may broadcast its identifier along with any existing sensor information through the wireless network.

Figure 4:
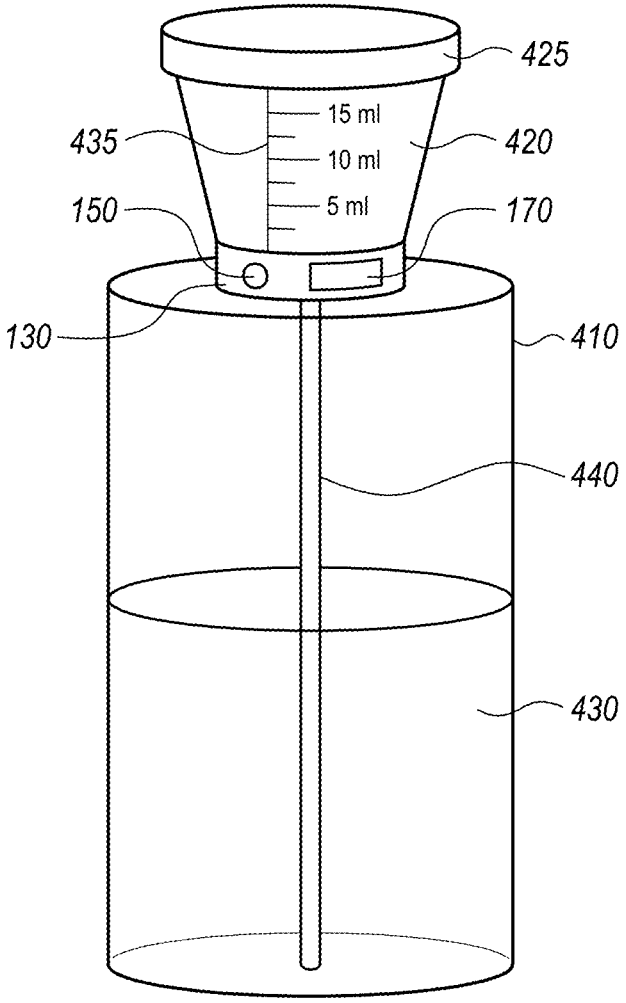
FIG. 4 shows a front view of a Smart Liquid Dispenser System having two containers.

FIG. 4 shows an alternate embodiment Smart Liquid Dispenser System 400 having two containers: primary container 410 and the secondary container 420. Secondary container 420 can have a cover 425. Primary container 410 holds liquid 430 for the majority of the time, and secondary container 420 is temporary, holding the amount of liquid 430 to be dispensed right before dispensing. The whole or a part of secondary container 420 may be made of transparent material so that the liquid level can be seen.

System 400 has an ECU 130, wherein ECU 130 receives a command from a user via a user input such as through buttons 150 or with voice through a microphone (seen in FIG. 1A). The command can cause a required amount of liquid 430 to be pumped from primary container 410 to secondary container 420 via a tube 440. Measure 435 on secondary container 420 allows the user to visually verify the volume of liquid 430 prior to dispensing.

Additionally, display 170 can show the medicine name and dosage, and any other operation information. A wireless receiver may be used to link to a pharmacy or doctor's office from a remote distance. ECU 130 may have an alarm to remind a user to take the medication in a specific time and proper amount. An orientation sensor (not shown here) can provide information regarding whether the medicine has been moved. This can let a user know if the medication is being used properly.

Figure 5A:
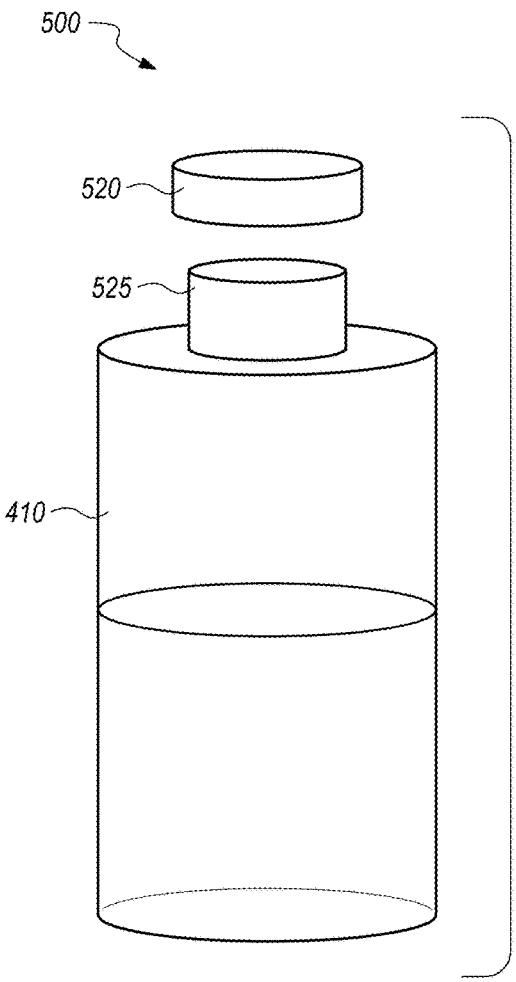
FIG. 5A shows a front view of a bottom half of a Smart Liquid Dispenser System.
Figure 5B:
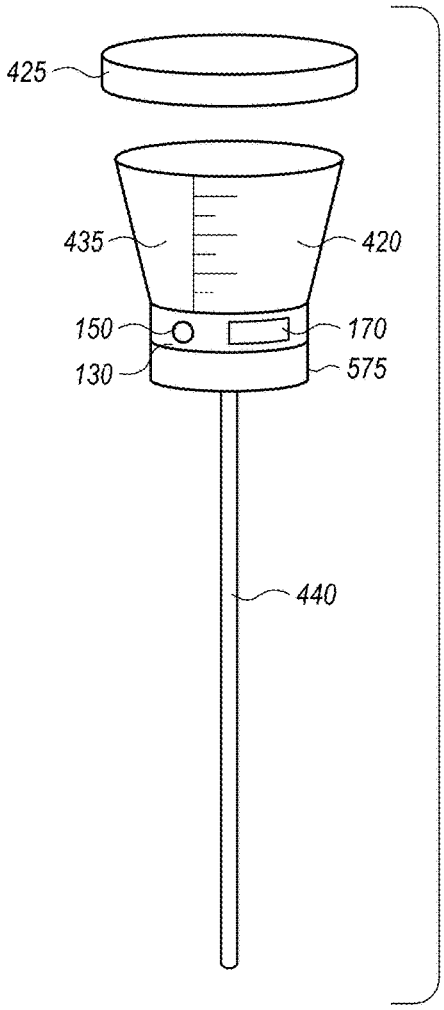
FIG. 5B shows a front view of a top half of a Smart Liquid Dispenser System having a universal connector.

FIGS. 5A-5B show an example of a Smart Liquid Dispenser System having a bottom half 500 and a top half 510, respectively. FIG. 5A shows bottom half of Smart Liquid Dispenser System 500 with a primary container 410 (as seen in FIG. 4), a cap 520 and bottle top 525. FIG. 5B shows top half of Smart Liquid Dispenser System 510 with a secondary container 420 having a cover 425 and a measure 435, tube 440 (both seen in FIG. 4), and a universal connector 515 that can be universally used with various types of bottles having different shapes and sizes. Universal connector 515 sits right below an electronic control unit (ECU) 130 as seen in previous figures, which is right below secondary container 420. ECU 130 can have a button 150 and a display 170.

To use the Smart Liquid Dispenser System shown in FIGS. 5A-5B, first remove cap 520 from primary container 410 and then place top half of Smart Liquid Dispenser System 510 on bottle top 525. Universal connector 515 helps top half of Smart Liquid Dispenser System 510 to fit easily to primary container 410. The operation of dispensing liquid is similar to previous embodiments that allow a user to use button 150 or voice-command via a speaker (not shown). Secondary container 420 and tube 440 may have varying shapes and sizes. Liquid can be pumped up or down, in or out, or to and from secondary container 420 and primary container 410. The liquid from the secondary container can be dispensed via an opened cover 425 or via tube 440. Tube 440 can be flexible or stiff that can be injected into objects or organisms.

Figure 6:
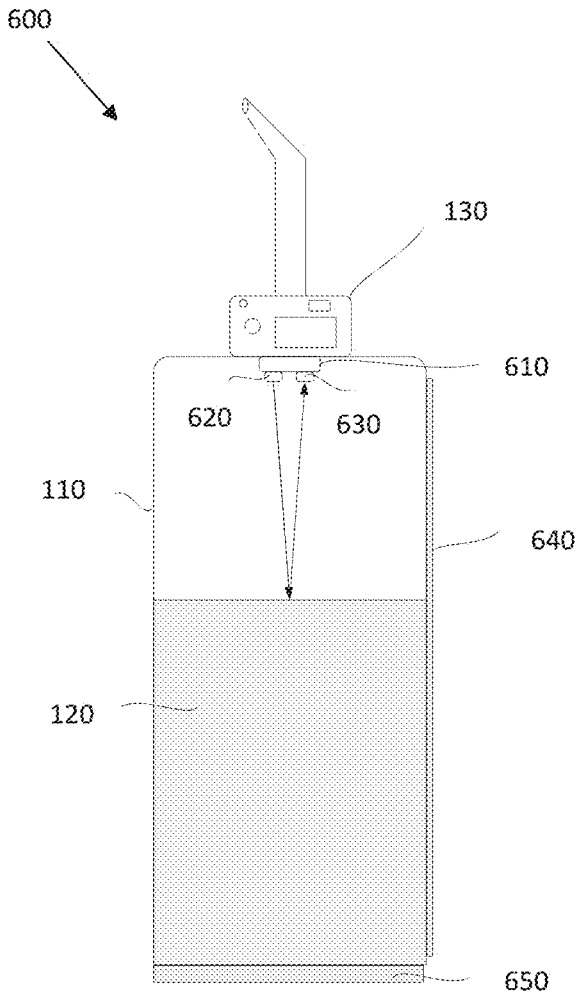
FIG. 6 shows a front view of a Smart Liquid Dispenser System having optical and compression sensors.

FIG. 6 shows a Smart Liquid Dispenser system 600 having various sensors that may be used to measure the amount of liquid remaining in the bottle. System 600 has a container 110 and liquid 120. Similar to previous figures, system 600 has an ECU 130, however directly inside container 110 there is an optical sensor 610 having an emitter 620 and a receiver 630. Optical sensor 610 emits light ray signals via emitter 620, and the reflected light received by receiver 630 measures the distance from the top of the bottle to the liquid level, so the liquid level can be determined. The optical sensors can be used to detect the chemical nature of the liquid. A pressure sensor 650 placed at the bottom of container 110 can measure the pressure of the height of liquid 120. Pressure sensor 650 can be used to determine the amount of liquid 120 in container 110.

Figure 7A:
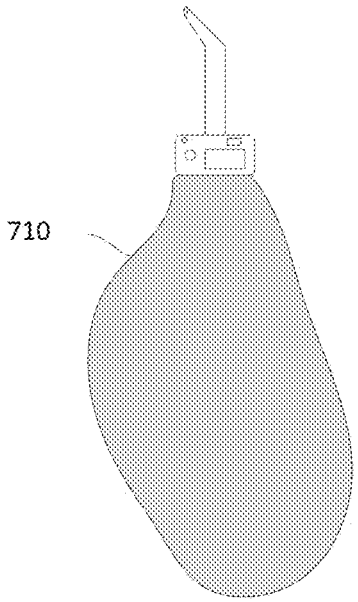
FIGS. 7A-7B show a front view of a Smart Liquid Dispenser System having a flexible container.
Figure 7B:
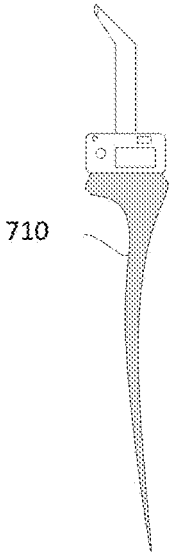

FIGS. 7A-7D have alternate embodiments for liquid containers. FIG. 7A shows a container 710 having a flexible soft body (similar to a plastic bag). In this embodiment, container 710 is filled with liquid. FIG. 7B shows container 710 after liquid has been pumped out, where the body of container 710 has shrunk down to a smaller size. There is no air valve needed for this embodiment.

Figure 8A:
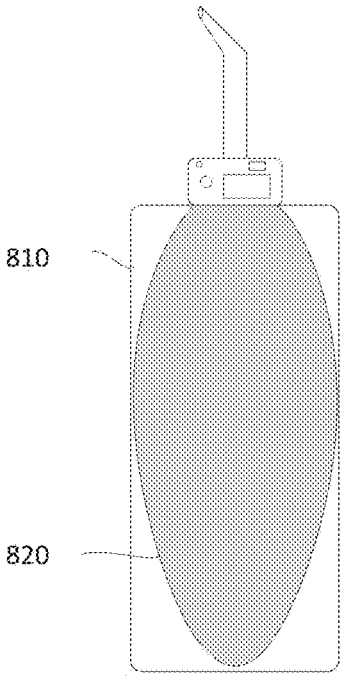
FIGS. 8A-8B show a front view of a Smart Liquid Dispenser System having an inside and an outside container.
Figure 8B:
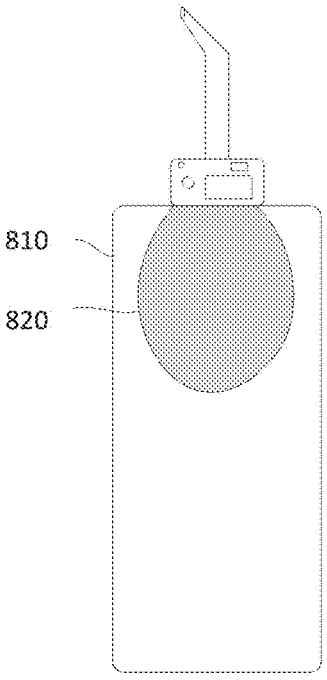

FIGS. 8A and 8B show a smart liquid dispenser system having two containers: one outside and one inside. The outside has a fixed size and shape, allowing a user to hold onto the container. FIG. 8A has outside container 810 and inside container 820 with insider container 820 filled with liquid. Inside container 820 may be flexible, and it is inflated when full of liquid. FIG. 8B shows outside container 810 and inside container 820 after liquid has been pumped out. An electric pump may not be needed at the nozzle, because when inside container 820 is inflated, it has its internal pressure to push liquid out.

Figure 9A:
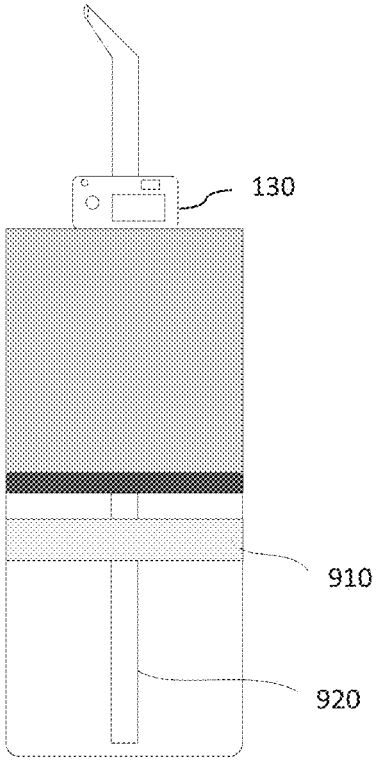
FIG. 9 shows a front view of a Smart Liquid Dispenser System having an actuator and an actuator rod.
Figure 9B:
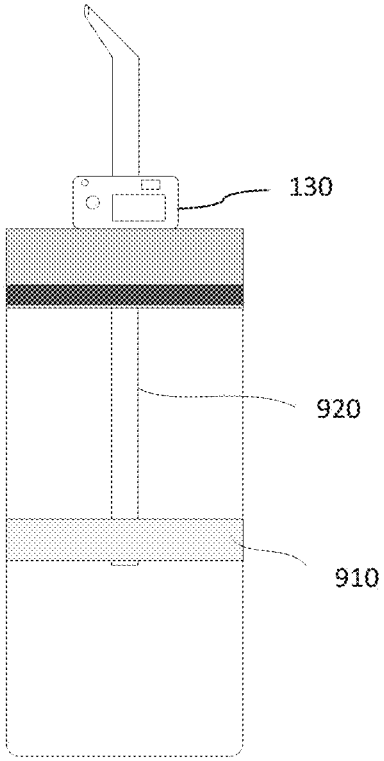

FIGS. 9A and 9B show a smart liquid dispenser system having an electric linear actuator 910. An ECU 130 commands actuator 910 to activate an actuator rod 920 to move upwards in order to push liquid out. FIG. 9A shows a system having liquid where actuator rod 920 is in a downward position. FIG. 9B shows a system where actuator rod 920 is in the upward position, having pushed liquid out.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

I claim:

1. A system for dispensing liquid comprising:

a container body having a top end and a bottom end, the bottom end being closed and the top end configured to open and close, the top end having an electrical controller and a nozzle member, the nozzle member configured to sit on top of the electrical controller, and the bottom end having a charge circuit and an air valve;

the electrical controller comprising a speaker, a button, a display, a battery, a radio frequency transceiver, and a pumper, wherein the electrical controller is configured to connect to a network and wherein the pumper is configured to dispense liquid from the container body out through the nozzle member.

2. The system of claim 1 wherein a measuring cup replaces the nozzle member.

3. The system of claim 1 wherein the container is made up of a flexible material that can expand and shrink.

4. The system of claim 1, wherein the electric controller further comprises a plurality of sensors.

5. The system of claim 4, wherein the plurality of sensors includes at least one of an orientation sensor, a liquid level sensor, a pressure sensor, a temperature sensor, an optical sensor, and a compression sensor.

6. The system of claim 5 wherein the electric controller is electrically connected to a host controller network, wherein the electric controller is configured to communicate with the host controller network.

7. The system of claim 5 wherein the electric controller further comprises a memory storage unit.

8. The system of claim 7 wherein the electric controller further comprises a battery.

9. The system of claim 8 wherein the charge circuit is configured to be electrically coupled to a power supply unit.

10. The system of claim 9, wherein the pumper comprises an electric linear actuator comprising a rod, and wherein the actuator and rod are disposed inside of the container, and wherein the actuator is configured to command the rod to move up and down causing liquid to be pushed out of the nozzle.

* * * * *